US006378844B1

(12) United States Patent
Weaver

(10) Patent No.: US 6,378,844 B1
(45) Date of Patent: Apr. 30, 2002

(54) MANUAL WELL PULLER

(76) Inventor: Russell A. Weaver, 2257 Hwy. 96, Franklinton, NC (US) 27525

( * ) Notice: Subject to any disclaimer, the term of this patent is extended or adjusted under 35 U.S.C. 154(b) by 0 days.

(21) Appl. No.: 09/895,706

(22) Filed: Jul. 2, 2001

(51) Int. Cl.[7] ..... B63B 35/03

(52) U.S. Cl. ..... 254/134.3 R; 226/187; 254/30; 166/76

(58) Field of Search ..... 254/30, 29 R; 166/76, 77, 85, 384; 226/187, 183, 186, 188, 170, 176, 181

(56) References Cited

U.S. PATENT DOCUMENTS 3,741,525 A * 6/1973 Smedley ..... 254/139
3,871,618 A * 3/1975 Funk ..... 254/30
4,986,351 A * 1/1991 Bowers ..... 166/85
5,253,845 A * 10/1993 Wilbert ..... 254/30
5,735,351 A * 4/1998 Helms ..... 166/384

* cited by examiner

*Primary Examiner*—Joseph J. Hail, III
*Assistant Examiner*—Daniel Shanley
(74) *Attorney, Agent, or Firm*—Mills Law Firm PLLC

(57) ABSTRACT

A manual well puller includes a lower slotted bracket that slides over the upper end of a well casing, a lower roller assembly for vertically guiding withdrawal of the well pipe, and an outwardly inclined support arm carrying rotatable guide wheels for enabling a repair to horizontally withdraw the well pipe thereby avoiding direct vertical lifting of the pipe and attached pump.

6 Claims, 4 Drawing Sheets

MANUAL WELL PULLER

FIELD OF THE INVENTION

The present invention relates to well equipment, and, in particular, a manually operated portable apparatus for removing pipe and associated pump from a well casing.

BACKGROUND OF THE INVENTION

Wells for water supplies, residential and business, oftentimes require servicing and/or replacement of components. Larger repairing services frequently employ cranes, motorized equipment and other heavy equipment for pulling the pipe from the well casing. In one such approach as disclosed in U.S. Pat. No. 6,119,910 to Beaudoin, adjustable motor driven drive wheels engage and lift the well pipe. Such an elaborate and costly apparatus is beyond the means of most well servicers. Similar motorized, wheel driven pullers are disclosed in U.S. Pat. No. 5,934,537 to Miller, U.S. Pat. No. 5,253,845 to Wilbert, and U.S. Pat. No. 5,996,971 to Crouse. A simpler approach using a vehicle or a crank operated windlass is disclosed in U.S. Pat. No. 4,88,997 to Ainsworth.

Many small servicing businesses are nonetheless reluctant to use, or unable to afford the expense and complexity of the foregoing approaches, and instead rely on manual withdrawal of the well pipe, associated cabling, and attached pump. Inasmuch as direct lifting of considerable weight is required, the removal is strenuous and can lead to physical complications, such as back problems. Accessory equipment, directly clamped to the well casing, have been to alleviate problems associated with direct lifting such as disclosed in U.S. Pat. No. 4,986,351 to Bowers. Therein, a collar is bolted at the top of the casing, and a large V-shaped guide wheel is used to enable the repairer to horizontally pull the cable from the well. The apparatus requires time consuming assembly on the casing, and is cumbersome and difficult to load and store in a typical repair vehicle.

SUMMARY OF THE INVENTION

The present invention provides a lightweight, compact well puller that may be, directly and without assembly, placed on the well casing and with ergonomic design allow the repairer to assume favorable body position for easily withdrawing the well pipe and pump from the casing. The foregoing is accomplished by a manual well puller having a slotted lower bracket and upwardly and outwardly inclined support arm terminating with rotatable wheels bounded by side guide plates. The lower bracket conveniently slips over the upper rim of the casing, permitting installation without assembly or specialized tools. A lower roller that is self-centered over the casing permits vertical withdrawal of the well pipes without engaging the casing wall. The extracted well pipe passes over the lower roller, along the support arm and over the upper guide wheels where the repairer may pull the cable in favorable body positions. The well puller is sturdy and light weight, without large moving parts, and may be readily transported and installed by a single repairer. The well puller is also compact and may be easily stored and transported in a typical repair pickup or utility vehicle.

DESCRIPTION OF THE DRAWINGS

The above and other objects and advantages of the present invention will become apparent upon reading the following detailed description taken in conjunction with the accompanying drawings in which.

DETAILED DESCRIPTION OF THE PREFERRED EMBODIMENTS

Figure 1:
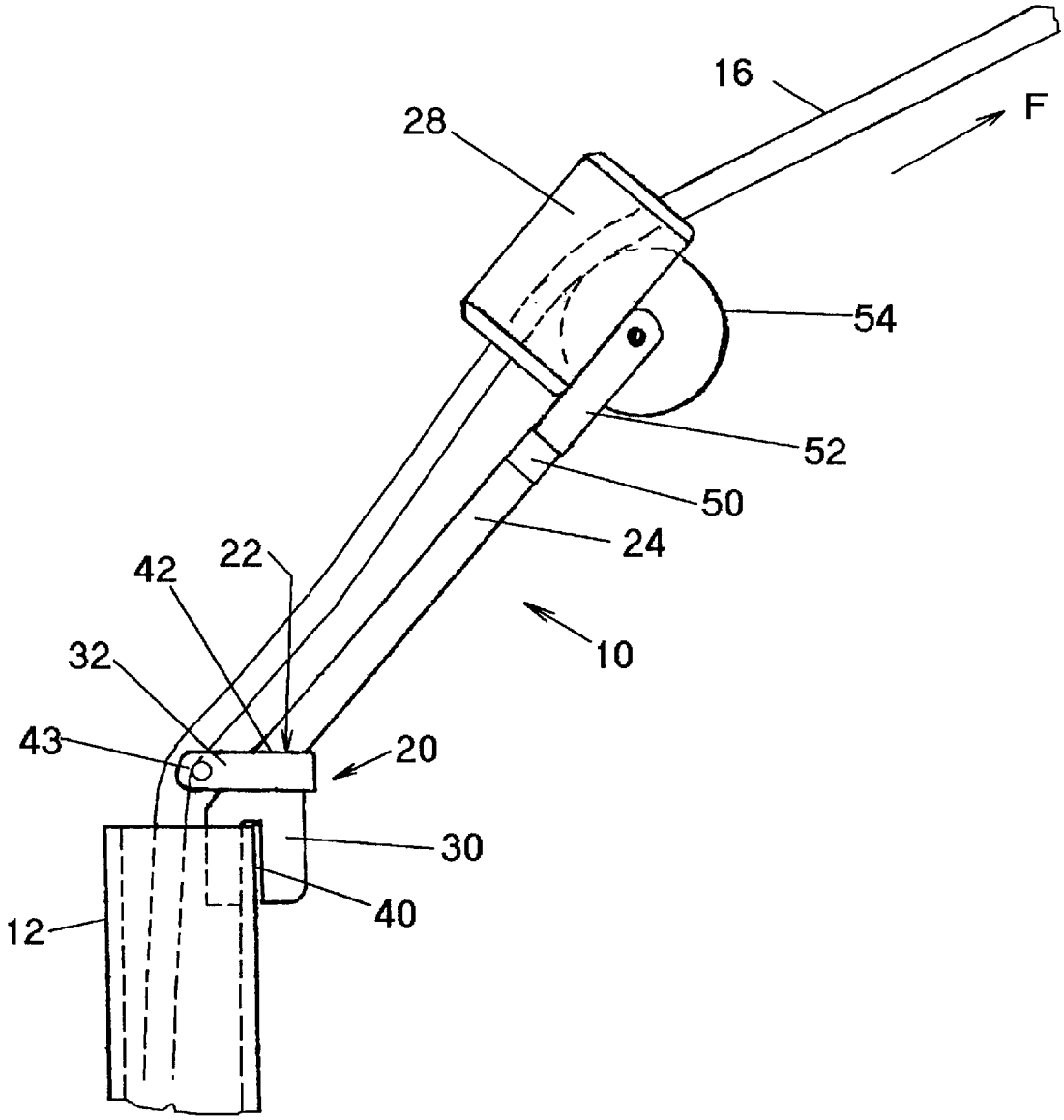
FIG. 1 is a partially sectioned side elevational view of a manual well puller in accordance with an embodiment of the invention mounted on a well casing.
Figure 2:
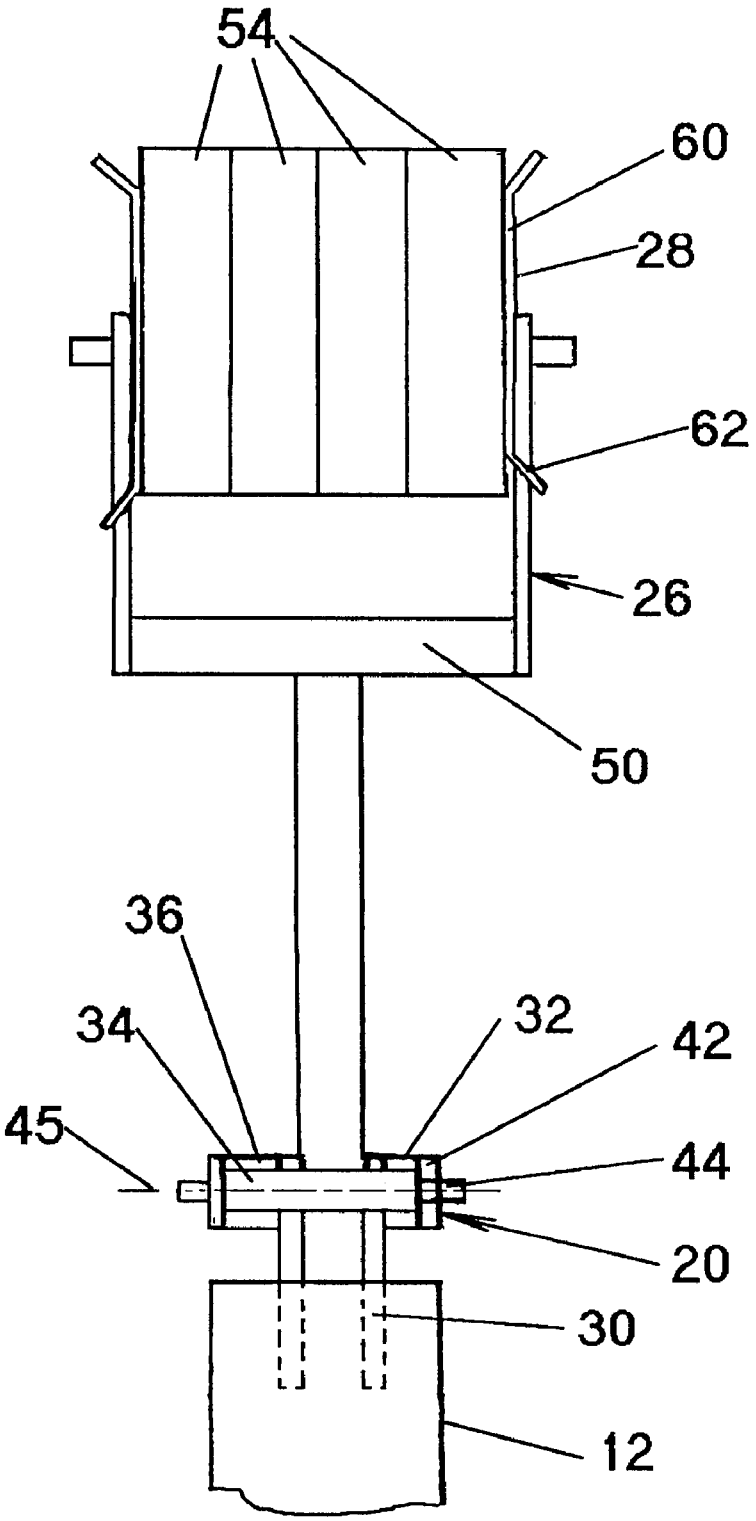
FIG. 2 is a front elevational view of the well puller shown in FIG. 1.
Figure 3:
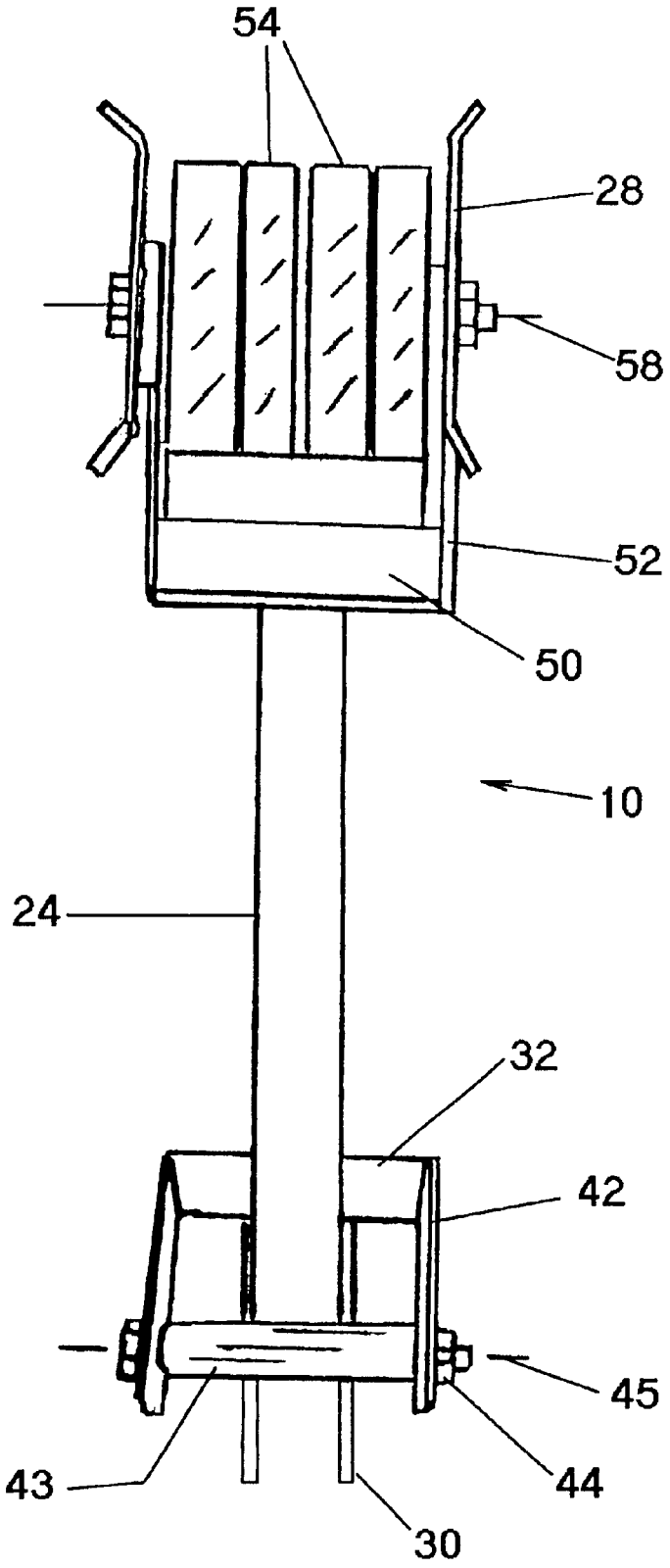
FIG. 3 is a front perspective view of the well puller.

Referring to the drawings for the purpose of describing the preferred embodiment and not for limiting same, FIG. 1 illustrates a manual well puller 10 in accordance with the invention operatively mounted on a well casing 12. As described in detail below, the well puller 10 facilitates the manual removal of a flexible well pipe 16, associated wiring, and a pump, not shown, from the casing 12, using primarily horizontally directed forces from favorable body positions that minimizes back strains.

The well puller 10 comprises a casing bracket 20 that slides over the upper end of the casing 12, a lower guide assembly 22 for initial vertical guided alignment of the well pipe 16, an angled support arm 24 terminating with an upper guide assembly 26 including lateral guide plates 28 for guiding the well pipe 16 during withdrawal from the casing 12.

The casing 12 is may be a conventional standard galvanized pipe construction having a cylindrical cross section and conventional wall thickness. The casing bracket 20 includes a pair of laterally spaced, slotted mounting plates 30, a U-shaped alignment bracket 32, and a guide roller 34. The mounting plates 30 are attached at rear vertical surfaces to the base 36 of the roller bracket 32 by suitable fasteners, such as welds, and at inwardly facing side surfaces to the sides of the lower end of the support arm 24, by suitable fasteners such as welds.

The mounting plates 30 have laterally aligned, downwardly opening slots 40. The width of the slots 40 establishes a sliding fit with the perimeter wall of the casing 12, allowing the well puller 10 to be readily aligned and lower into position.

The alignment bracket 32 has forwardly projecting arms 42. A guide roller 43 is pivotally supported at the ends of the arms 42 on a fastener 44 for rotation about a horizontal axis 45 transverse to the support arm 24 that is located at about the vertical axis 46 of the casing such that the lower run of the well pipe 16 extending therebelow is approximately centered in the casing.

The support arm 24 is formed of rectangular metal tubing and extends outwardly and upwardly from the axis 46 at an angle in the range of about 45° to 75° and preferably around 60°.

The upper guide assembly 26 is connected at the upper terminal end of the support arm 24. The upper guide assembly 26 includes a rectangular cross bar 50 attached to the end of the support arm 24, and a pair of laterally spaced mounting arms 52 attached at lower ends to the ends of the cross bar 50 and extending generally parallel to the support arm 24. The guide roller assembly 30 includes four cylindrical wheels 54 having elastomeric outer surface treads rotatably disposed between the mounting arms 52 on the cylindrical shank of threaded fastener 56 for rotation about a horizontal axis 58 transverse to the support arm 24.

The guide plates 40 include a rectangular base 60 attached to the inner surface of the mounting arms 52 and interposed between the adjacent outer wheels 54. The base 60 projects outwardly beyond the wheels 54 sufficient to provide affirmative support for the pipe 20 during withdrawal from the casing 12 notwithstanding varying pulling positions assumed by the repairer during withdrawal. Outwardly flared guide wings 62 are formed at the upper and lower ends of the base 60 of the guide plate 28 for providing a continuous guiding surface without sharp or rough edges to minimize damage to the well pipe during removal. Disposed on a typical well casing, the upper guide wheels provide a guide path for the upper run of the pipe disposed at least about waist level of the operator to provide for convenient removal without significant back bending.

In operation, the repairer conveniently, after removal of the well casing cover and extraction of a starting run of pipe, slides the mounting bracket on top of the casing and threads the pipe initially over the lower guide roller 44, and subsequently along the support arm and over the guide wheels. Positioned at a comfortable orientation with respect to the well puller, the repairer may readily withdraw the well pipe, benefiting from the guiding rollers and wheels and the ergonomic disposition thereof. The overall assembly is lightweight without moving parts, and after use may be conveniently removed and easily stored and transported for future use.

Figure 4:
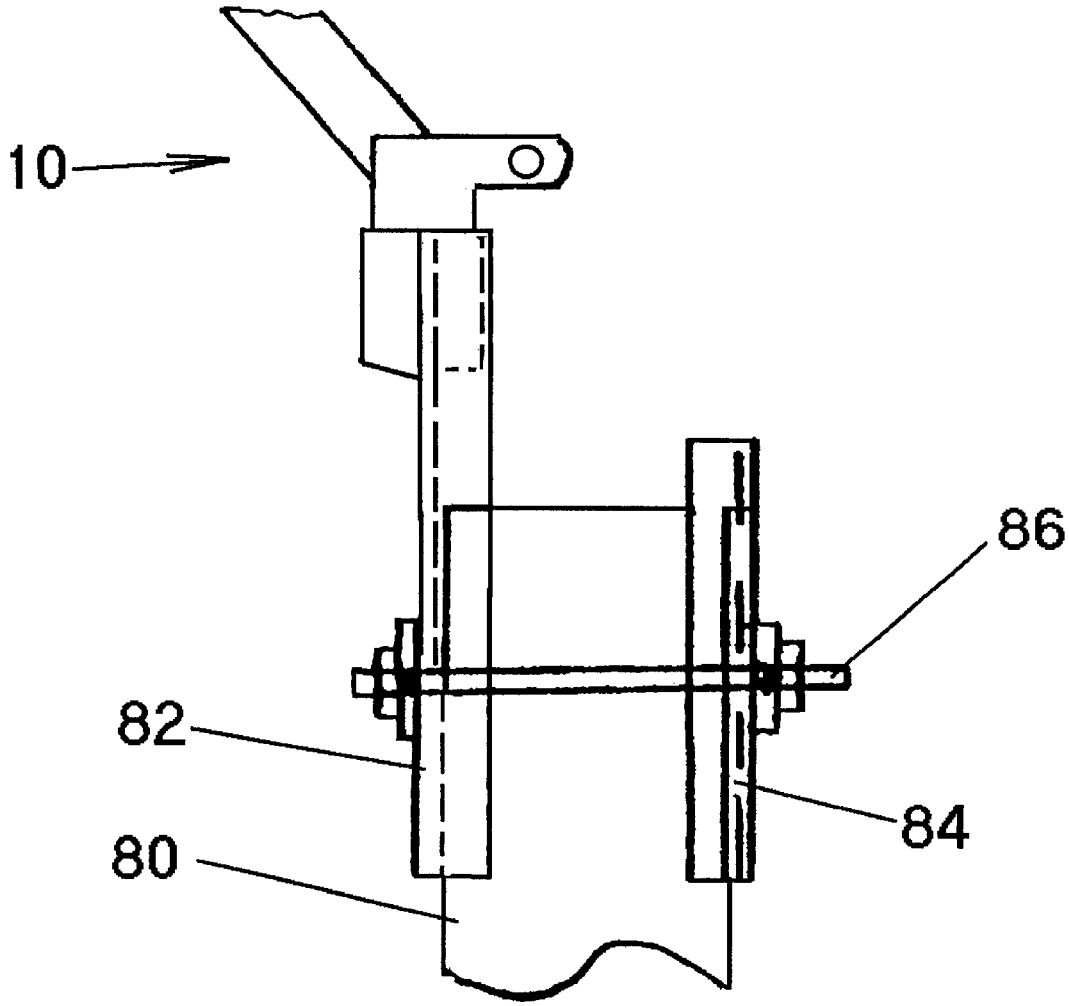
FIG. 4 is a fragmentary side view of the well puller of FIG. 1 mounted on an adapter connected to a well casing.

The well puller 10 as described above may also be used on plastic well casing 80, such as PVC pipe, as shown in FIG. 4. To guard against fracture or damage to the pipe 80 by direct mounting thereon, clamping brackets 82 and 84 are clamped to the casing 80 with threaded fasteners 86. Thereafter, the well puller 10 may be disposed thereon and operated as described above.

Having thus described a presently preferred embodiment of the present invention, it will now be appreciated that the objects of the invention have been fully achieved, and it will be understood by those skilled in the art that many changes in construction and widely differing embodiments and applications of the invention will suggest themselves without departing from the sprit and scope of the present invention. The disclosures and description herein are intended to be illustrative and are not in any sense limiting of the invention, which is defined solely in accordance with the following claims.

What is claimed:

1. A manual well puller for withdrawing flexible well pipe from a cylindrical well casing comprising: a lower bracket, said lower bracket including a pair of laterally spaced planes, said spaced plates having downwardly opening slots having a width slightly larger than the thickness of the well casing and establishing a sliding fit therewith thereby effecting a sliding mounting on the upper end of the well casing; an elongated cylindrical lower guide roller pivotally mounted on said lower bracket and aligned in use with about the center of the well casing, said lower guide roller having a width substantially greater than the well pipe; an upwardly and outwardly inclined support arm attached at a lower end to said lower bracket; an upper guide assembly attached an upper end of said support arm, said upper guide assembly including a cylindrical upper loller member for rotatably supporting said well pipe during withdrawal, said upper roller member having a width substantially greater that the well pipe; and laterally spaced guide plates carried on said upper guide assembly adjacent the ends of said upper roller member, said side guide plates extending upwardly of said upper roller means on either side of said upper roller member, said guide plates laterally retaining said well pipe on said upper guide member during withdrawal of the well pipe.

2. The manual well puller as recited in claim 1 wherein said lower roller is transverse to said support arm and bounded by lateral surfaces for additionally laterally retaining the well pipe therebetween during withdrawal.

3. The manual well puller as recited in claim 2 wherein said upper roller member on said upper guide assembly is transverse to said support arm.

4. The manual well puller as recited in claim 2 wherein guide plates include outwardly diverging guide surfaces.

5. The manual well puller as recited in claim 2 wherein said upper roller member is covered with an elastomeric tread.

6. The manual well puller as recited in claim 2 including an adapter member having an upper end for slidably receiving said lower bracket at said slots and an lower end for engaging the outer surface of the casing, and further including means for compressively clamping said adapter member to said casing.

* * * * *